US009945245B2

(12) United States Patent
Inoue et al.

(10) Patent No.: US 9,945,245 B2
(45) Date of Patent: Apr. 17, 2018

(54) VARIABLE NOZZLE UNIT AND VARIABLE GEOMETRY SYSTEM TURBOCHARGER

(71) Applicant: IHI Corporation, Koto-ku (JP)

(72) Inventors: Tomohiro Inoue, Tokyo (JP); Takao Asakawa, Tokyo (JP); Kenichi Segawa, Tokyo (JP)

(73) Assignee: IHI Corporation, Koto-ku (JP)

( * ) Notice: Subject to any disclaimer, the term of this patent is extended or adjusted under 35 U.S.C. 154(b) by 1102 days.

(21) Appl. No.: 14/178,683

(22) Filed: Feb. 12, 2014

(65) Prior Publication Data

US 2014/0248135 A1 Sep. 4, 2014

(30) Foreign Application Priority Data

Mar. 1, 2013 (JP) ..... 2013-040734

(51) Int. Cl.

| | |
|---|---|
| ***F04D 29/44*** | (2006.01) |
| ***F01D 17/14*** | (2006.01) |
| ***F01D 17/16*** | (2006.01) |

(52) U.S. Cl.

CPC ..... *F01D 17/14* (2013.01); *F01D 17/165* (2013.01); *F05D 2220/40* (2013.01)

(58) Field of Classification Search

CPC ..... F01D 17/00; F01D 17/14; F01D 17/141; F01D 17/16; F01D 17/165; F01D 17/167

USPC ..... 415/148, 150, 159, 163

See application file for complete search history.

(56) References Cited

U.S. PATENT DOCUMENTS

| | | | | |
|---|---|---|---|---|
| 4,804,316 | A * | 2/1989 | Fleury | F01D 17/165 415/134 |
| 2007/0068155 | A1* | 3/2007 | Hayashi | F01D 17/165 60/602 |
| 2008/0075582 | A1 | 3/2008 | Sausse et al. | |
| 2008/0223956 | A1* | 9/2008 | Jinnai | F01D 17/165 239/265.35 |
| 2011/0014033 | A1* | 1/2011 | Boning | F01D 17/165 415/148 |
| 2013/0004298 | A1* | 1/2013 | Ramb | F01D 17/165 415/148 |

FOREIGN PATENT DOCUMENTS

| | | | |
|---|---|---|---|
| CN | 1821552 | A | 8/2006 |
| CN | 101864996 | A | 10/2010 |
| CN | 102667100 | A | 9/2012 |

(Continued)

OTHER PUBLICATIONS

Translated Description of Burmester et al., DE 102004043928 (Apr. 2006). Accessed EPO website Jun. 28, 2017. 5 pages.*

(Continued)

*Primary Examiner* — Logan Kraft
*Assistant Examiner* — Jason Fountain
(74) *Attorney, Agent, or Firm* — Oblon, McClelland, Maier & Neustadt, L.L.P.

(57) ABSTRACT

Multiple guide claws are formed integrally on a right side surface of a first nozzle ring of a variable nozzle unit and radially at intervals in a circumferential direction. Each guide claw has a guide groove with a U-shaped cross section, which is formed by lathe turning. A projecting portion is formed at an inner edge portion on the right side surface of the first nozzle ring. The projecting portion is formed on base portions of the multiple guide claws.

10 Claims, 6 Drawing Sheets

(56) References Cited

FOREIGN PATENT DOCUMENTS

| | | | | |
|---|---|---|---|---|
| DE | 102 38 412 | A1 | | 3/2004 |
| DE | 10 2004 023 210 | A1 | | 12/2005 |
| DE | 10 2004 043 928 | A1 | | 4/2006 |
| DE | 102004043928 | | * | 4/2006 |
| DE | 11 2010 004 597 | T5 | | 1/2013 |
| EP | 1 564 380 | A1 | | 8/2005 |
| JP | 2007-187015 | A | | 7/2007 |
| JP | 2009-243300 | | | 10/2009 |
| JP | 2009-243431 | | | 10/2009 |
| JP | 2010-169101 | A | | 8/2010 |
| JP | 2010-229908 | A | | 10/2010 |
| JP | 2011-515608 | A | | 5/2011 |
| WO | WO 2008/036862 | A2 | | 3/2008 |
| WO | WO 2012/005171 | A1 | | 1/2012 |

OTHER PUBLICATIONS

Office Action dated Sep. 16, 2014 in German Patent Application No. 10 2014 203 354.3 (with English language translation).
Combined Office Action and Search Report dated Mar. 31, 2015 in Chinese Patent Application No. 201410062245.7 (with English language translation).
Combined Chinese Office Action and Search Report dated May 6, 2016 in Patent Application No. 201410062245.7 (with English translation of Categories of Cited Documents).
U.S. Appl. No. 14/187,477, filed Feb. 24, 2014, Inoue, et al.
Office Action dated Nov. 1, 2016 in Japanese Patent Application No. 2013-040734 with unedited computer generated English translation.

* cited by examiner

VARIABLE NOZZLE UNIT AND VARIABLE GEOMETRY SYSTEM TURBOCHARGER

BACKGROUND OF THE INVENTION

Field of the Invention

The present invention relates to a variable nozzle unit capable of making variable a passage area for (or a flow rate of) an exhaust gas to be supplied to a turbine impeller side in a variable geometry system turbocharger. The present invention also relates to a variable geometry system turbocharger.

Description of the Related Art

In recent years, various developments have been made with regard to a variable nozzle unit to be installed in a variable geometry system turbocharger. Japanese Patent Application Publications Nos. 2009-243300 and 2009-243431 disclose variable nozzle units of the related art. An essential configuration of the variable nozzle units is as follows.

In a turbine housing of a variable geometry system turbocharger, base rings are disposed concentrically with a turbine impeller. Each base ring is provided with multiple support holes formed in a penetrating manner. The support holes are arranged at equal intervals in a circumferential direction of the base ring. The base rings are also provided with multiple variable nozzles which are disposed to surround the turbine impeller at equal intervals in the circumferential direction of the base rings. Each variable nozzle rotates in a forward direction or a reverse direction (in an opening direction or a closing direction) about its pivot which is parallel to a pivot of the turbine impeller. Further, a nozzle shaft is integrally formed on a side surface of each variable nozzle, the side surface being located on one side in an axial direction of the turbine impeller. Each nozzle shaft is rotatably supported by a corresponding support hole provided in one of the base rings.

A guide ring is provided on one side, in the aforementioned axial direction, of the base rings. The guide ring is provided concentrically with the turbine impeller. Multiple support claws are formed radially on an outer peripheral edge of the guide ring at intervals in its circumferential direction. The multiple support claws support a drive ring rotatably in the forward direction and the reverse direction about the pivot of the turbine impeller. Here, the drive ring rotates in the forward direction or the reverse direction by the drive of a rotary actuator. The drive ring is provided with engagement portions which are as many as the variable nozzles. The engagement portions are arranged at equal intervals in the circumferential direction. In addition, a synchronous link member (a nozzle link member) is integrally connected to the nozzle shaft of each variable nozzle. A tip end of each synchronous link member is engaged with the corresponding engagement portion of the drive ring.

When the drive ring rotates in the forward direction, the multiple synchronous link members swing in the forward direction, whereby the multiple variable nozzles synchronously rotate in the forward direction (the opening direction). This increases the area of a passage for an exhaust gas to be supplied to the turbine impeller side. On the other hand, when the drive ring rotates in the reverse direction, the multiple synchronous link members swing in the reverse direction, whereby the multiple variable nozzles synchronously rotate in the reverse direction (the closing direction). This reduces the area of the passage for the exhaust gas.

As described above, the variable nozzle unit of the related art requires the guide ring, the drive ring, and the multiple synchronous link members as the configuration to rotate the multiple variable nozzles synchronously in the forward direction or the reverse direction. For this reason, the number of components of the variable nozzle unit increases and the configuration of the variable nozzle unit is complicated. In addition, the increase in the number of components leads to an increase in manufacturing costs of the variable nozzle unit, in other words, complication in a configuration of a variable geometry system turbocharger and an increase in manufacturing costs of the variable geometry system turbocharger.

SUMMARY OF THE INVENTION

An object of the present invention is to provide a variable nozzle unit and a variable geometry system turbocharger, each being capable of preventing complication in its configuration and an increase in manufacturing costs.

A gist of a first aspect of the present invention is a variable nozzle unit configured to adjust a passage area for an exhaust gas to be supplied to a turbine impeller in a variable geometry system turbocharger. The variable nozzle unit includes: a base ring disposed concentrically with the turbine impeller, the base ring including multiple support holes arranged in a circumferential direction of the base ring, and multiple guide claws formed integrally on a side surface of the base ring on one side in an axial direction of the turbine impeller and located radially at intervals in the circumferential direction, each guide claw having a guide groove on its tip end side; multiple variable nozzles disposed in the base ring in the circumferential direction to surround the turbine impeller, each variable nozzle being disposed rotatably about a pivot which is parallel to a pivot of the turbine impeller; a drive ring guided by the guide grooves of the guide claws so as to rotate in any of a forward direction and a reverse direction about the pivot of the turbine impeller, the drive ring including multiple engagement portions provided in a circumferential direction of the drive ring; and multiple synchronous link members, each including a base end portion integrally connected to a nozzle shaft of the corresponding variable nozzle, and a tip end portion engaged with the corresponding engagement portion of the drive ring.

It is to be noted that "disposed" carries connotations of a state of being directly disposed and a state of being indirectly disposed through the intermediary of a different component. Meanwhile, "disposed in the base ring at intervals in the circumferential direction to surround the turbine impeller" carries a connotation of a state of being disposed at intervals in the circumferential direction to surround the turbine impeller between a pair of base rings (a first base ring and a second base ring) located away from and opposed to each other in the axial direction. Further, "provided" carries connotations of a state of being directly provided, a state of being indirectly disposed through the intermediary of a different component, and a state of being formed.

A gist of a second aspect of the present invention is a variable geometry system turbocharger configured to supercharge air to be supplied to an engine by using energy of an exhaust gas from the engine, the variable geometry system turbocharger including the variable nozzle unit according to the first aspect.

The present invention can thus provide a variable nozzle unit and a variable geometry system turbocharger, each being capable of preventing complication in its configuration and an increase in manufacturing costs.

DETAILED DESCRIPTION OF EMBODIMENTS

Figure 1:
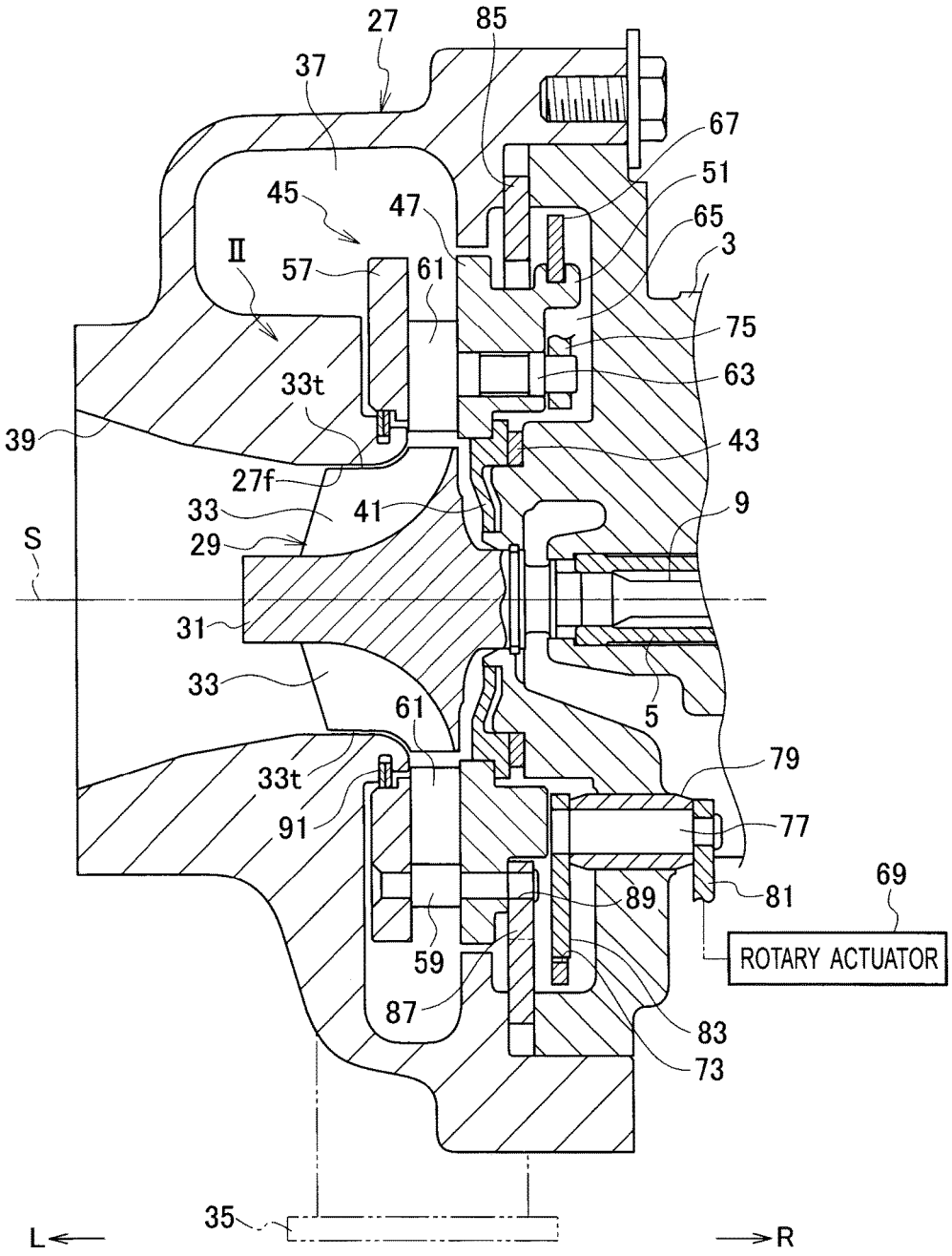
FIG. 1 is an enlarged view of a portion indicated with an arrow I in FIG. 6.

An embodiment of the present invention will be described below with reference to FIG. 1 to FIG. 6. In the drawings, the sign "R" indicates rightward while the sign "L" indicates leftward.

Figure 6:
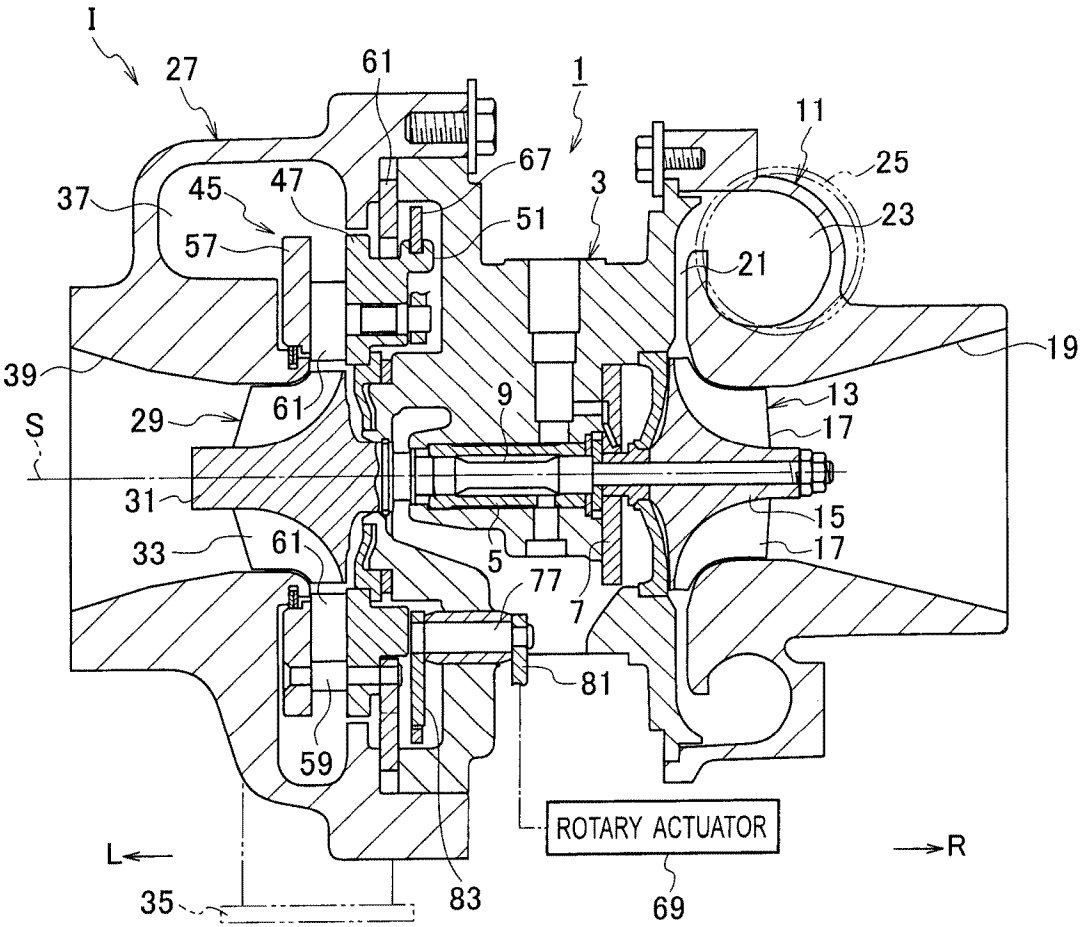
FIG. 6 is a front cross-sectional view of a variable geometry system turbocharger according to the embodiment of the present invention.

A variable geometry system turbocharger 1 according to the embodiment is shown in FIG. 6. The variable geometry system turbocharger 1 supercharges (compresses) air to be supplied to an engine (not shown) by using energy of an exhaust gas from the engine.

The variable geometry system turbocharger 1 includes a bearing housing 3. A radial bearing 5 and a pair of thrust bearings 7 are provided inside the bearing housing 3. In addition, a rotor shaft (a turbine shaft) 9 extending in a right-left direction is rotatably provided to the multiple bearings 5 and 7. In other words, the rotor shaft 9 is rotatably provided through the multiple bearings 5 and 7 inside the bearing housing 3.

A compressor housing 11 is provided on a right side of the bearing housing 3. Inside the compressor housing 11, a compressor impeller 13 is provided rotatably about its pivot S (in other words, a pivot of the rotor shaft 9). The compressor impeller 13 compresses the air by use of centrifugal force generated by its rotation. In the meantime, the compressor impeller 13 includes a compressor wheel (a compressor disk) 15 which is integrally connected to a right end portion of the rotor shaft 9, and multiple compressor blades 17 provided on an outer peripheral surface of the compressor wheel 15 at equal intervals in the circumferential direction.

An air introduction port 19 for introducing the air is formed on an inlet side (an upstream side in a direction of an air flow) of the compressor impeller 13 in the compressor housing 11. The air introduction port 19 is connected to an air cleaner (not shown) configured to clean up the air. Meanwhile, an annular diffuser passage 21 configured to pressurize the compressed air is formed on an outlet side (a downstream side in the direction of the air flow) of the compressor impeller 13 between the bearing housing 3 and the compressor housing 11. Moreover, a compressor scroll passage 23 in a scroll shape is formed inside the compressor housing 11. The compressor scroll passage 23 communicates with the diffuser passage 21. In addition, an air emission port 25 configured to emit the compressed air is formed at an appropriate position in the compressor housing 11. The air emission port 25 communicates with the compressor scroll passage 23, and is connected to an air intake manifold (not shown) of the engine.

As shown in FIG. 1 and FIG. 6, a turbine housing 27 is provided on a left side of the bearing housing 3. A turbine impeller 29 is provided in the turbine housing 27 in such a manner as to be rotatable about its pivot S (the pivot of the turbine impeller 29, or the pivot of the rotor shaft 9). The turbine impeller 29 generates rotational force (rotational torque) by using pressure energy of the exhaust gas. The turbine impeller 29 includes a turbine wheel (a turbine disk) 31 integrally provided at a left end portion of the rotor shaft 9, and multiple turbine blades 33 provided on an outer peripheral surface of the turbine wheel 31 at equal intervals in the circumferential direction. Here, tip end edges 33*t* of the multiple turbine blades 33 are covered with a shroud wall 27*f* of the turbine housing 27.

A gas introduction port 35 for introducing the exhaust gas is formed at an appropriate position in the turbine housing 27. The gas introduction port 35 is connected to an air exhaust manifold (not shown) of the engine. A turbine scroll passage 37 in a scroll shape is formed on an inlet side (an upstream side in a direction of an exhaust gas flow) of the turbine impeller 29 inside the turbine housing 27. The turbine scroll passage 37 communicates with the gas introduction port 35. Moreover, a gas emission port 39 for emitting the exhaust gas is formed on an outlet side (a downstream side in the direction of the exhaust gas flow) of the turbine impeller 29 in the turbine housing 27. The gas emission port 39 is connected to an exhaust emission control system (not shown) configured to clean up the exhaust gas.

A heat shield plate 41 is provided on a left side surface of the bearing housing 3. The heat shield plate 41 is formed in an annular shape, and blocks heat from the turbine impeller 29 side. An annular biasing member 43 such as a disc spring or a wave washer is provided between the left side surface of the bearing housing 3 and an outer edge portion of the heat shield plate 41.

The variable geometry system turbocharger 1 is equipped with a variable nozzle unit 45, which adjusts a passage area for (or a flow rate of) the exhaust gas to be supplied to the turbine impeller 29 side.

A configuration of the variable nozzle unit 45 will be described. As shown in FIG. 1 to FIG. 4B, a first nozzle ring 47 serving as a first base ring is disposed in the turbine housing 27 concentrically with the turbine impeller 29. The first nozzle ring 47 includes multiple support holes 49 arranged at equal intervals in the circumferential direction. The support holes 49 are formed to penetrate the first nozzle ring 47. Meanwhile, an inner edge portion of the first nozzle ring 47 is fitted to an outer edge portion (a step portion on an outer edge side) of the heat shield plate 41.

Figure 4B:
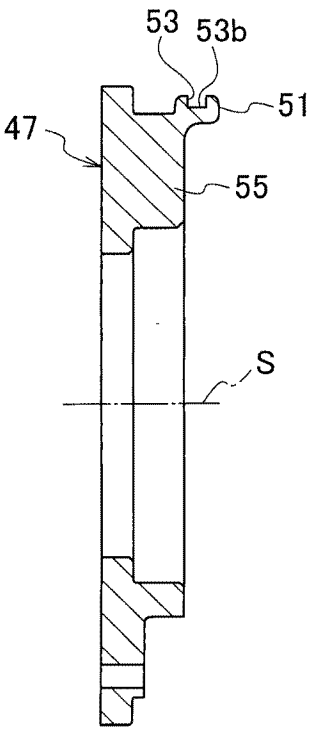
FIG. 4A is a view showing a nozzle ring according to the embodiment of the present invention and FIG. 4B is a cross-sectional view taken along the IVB-IVB line in FIG. 4A.
Figure 4A:
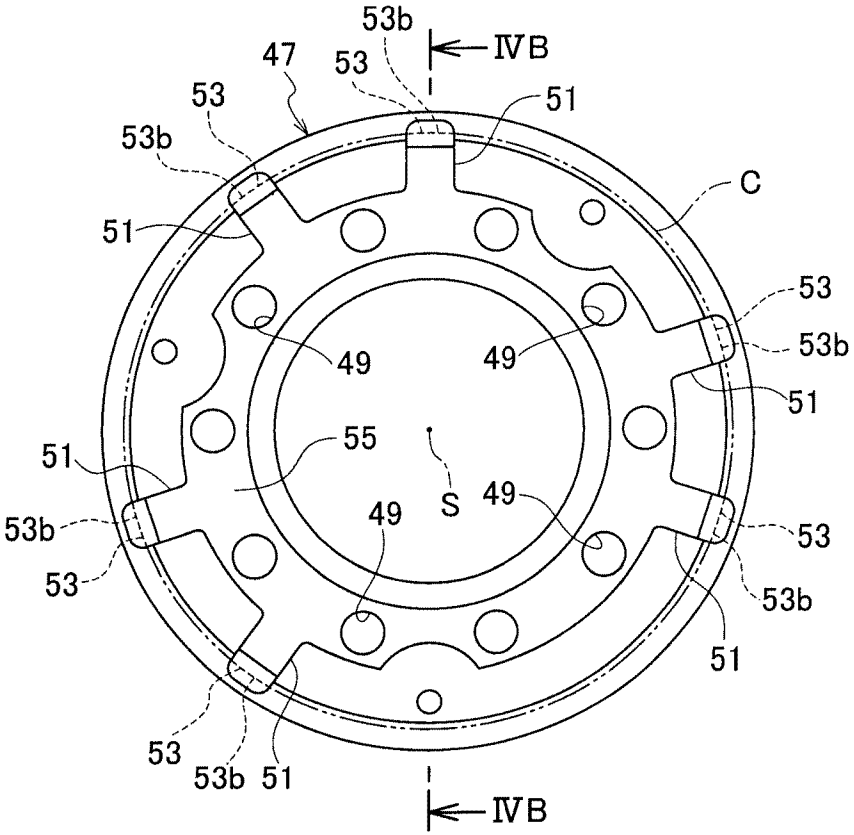
Figure 5B:
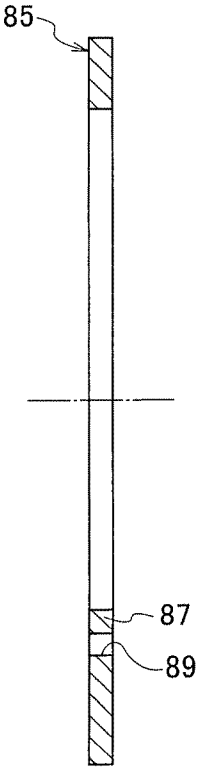
FIG. 5A is a view showing a support ring according to the embodiment of the present invention and FIG. 5B is a cross-sectional view taken along the VB-VB line in FIG. 5A.
Figure 5A:
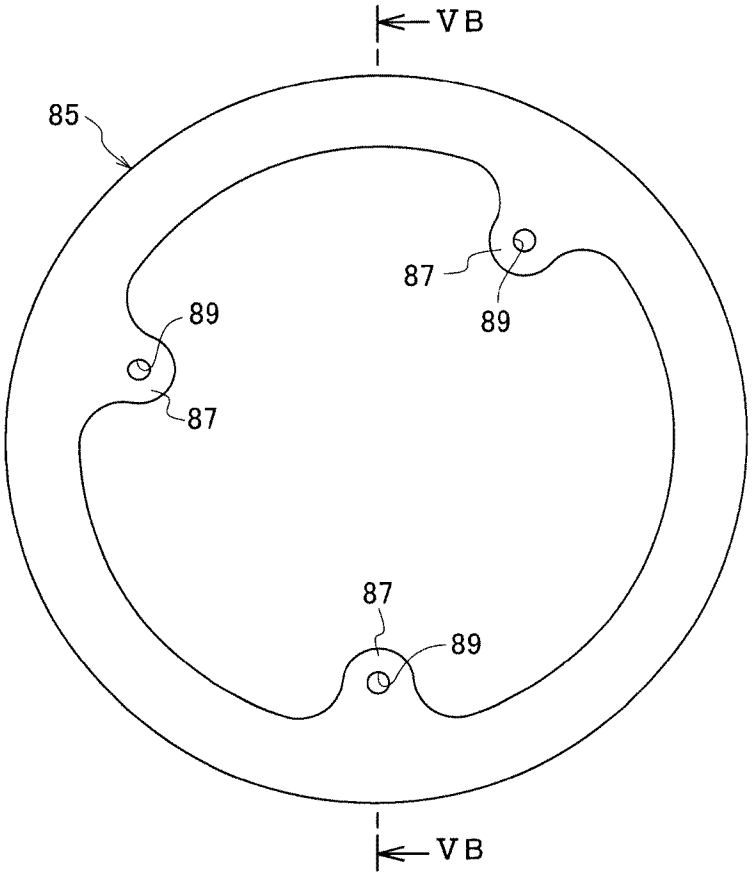

As shown in FIG. 4A and FIG. 4B, multiple guide claws 51 are integrally formed on a right side surface of the first nozzle ring 47 (a side surface on one side in an axial direction of the turbine impeller 29). The multiple guide claws 51 are located outside the support holes 49 in radial directions and are thus formed radially at intervals in the circumferential direction of the first nozzle ring 47. In addition, each guide claw 51 includes a guide groove 53 having a U-shaped cross section, which is formed on a tip end side (radially outer side) of the guide claw 51 by lathe turning. Bottom surfaces 53*b* of the guide grooves 53 are located on the same circumference C centered at the pivot S of the turbine impeller 29 (the pivot of the first nozzle ring 47). Furthermore, a projecting portion 55 is formed at an inner edge portion (on an inner peripheral surface side) of the right side surface of the first nozzle ring 47. The projecting portion 55 protrudes rightward (toward the one side in the aforementioned axial direction) from the first nozzle ring 47. Moreover, the projecting portion 55 is formed integrally with base portions of the guide claws 51, thereby increasing rigidity of each of the guide claws 51. Here, the projecting portion 55 may be formed in an annular shape, for example, so as to connect the base portions of the guide claws 51 to one another.

Figure 2:
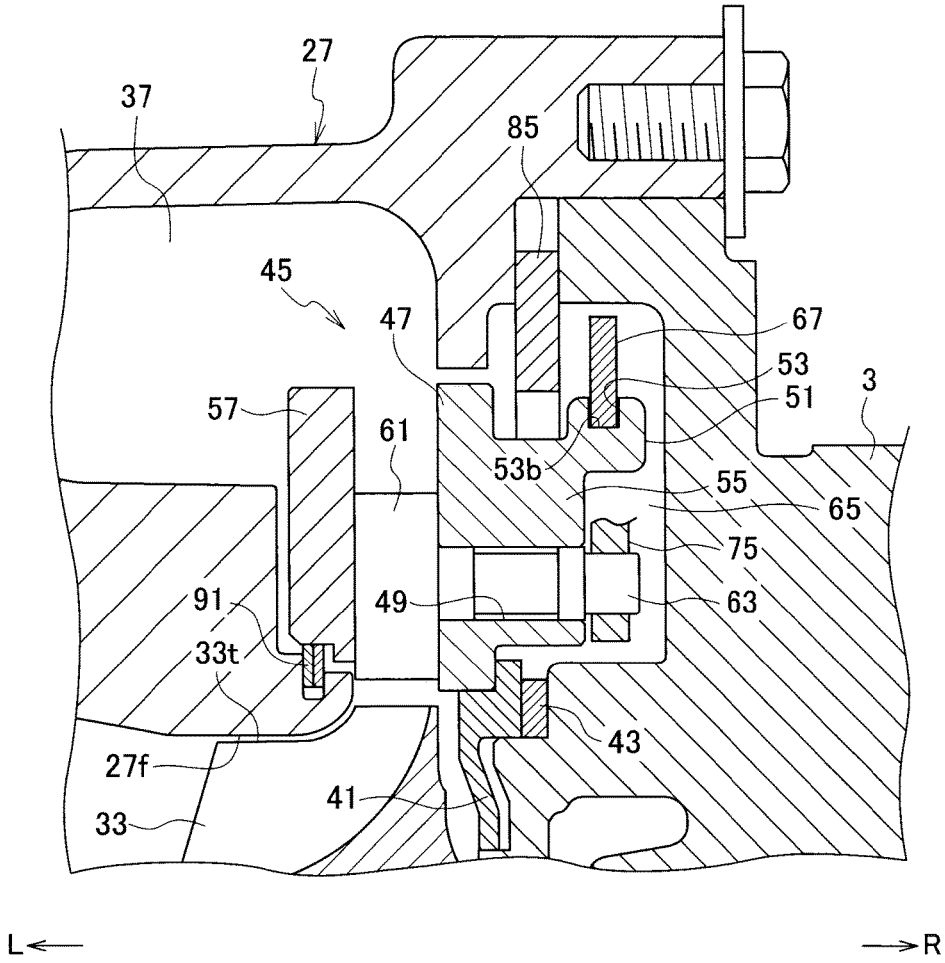
FIG. 2 is an enlarged view of a portion indicated with an arrow II in FIG. 1.
Figure 3:
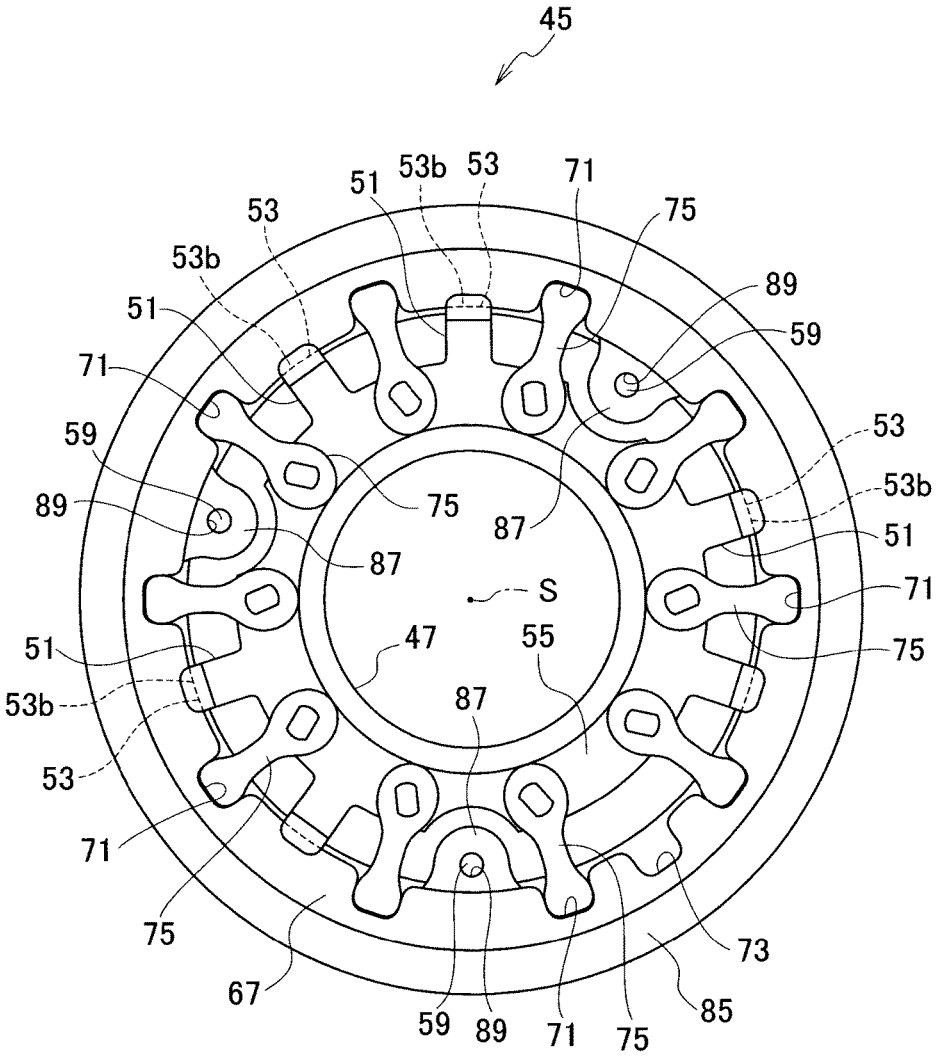
FIG. 3 is a view showing part of a variable nozzle unit according to an embodiment of the present invention.

As shown in FIG. 1 to FIG. 3, a second nozzle ring 57 serving as a second base ring is provided at a position which is away from and opposed to the first nozzle ring 47 in the right-left direction (the axial direction of the turbine impeller 29). The second nozzle ring 57 is provided integrally and concentrically with the first nozzle ring 47 by means of multiple (three or more) connecting pins 59 arranged in the circumferential direction of the second nozzle ring 57. The multiple connecting pins 59 define a clearance between a facing surface (a side surface on the other side in the axial direction of the turbine impeller 29) of the first nozzle ring 47 and a facing surface (a side surface on the one side in the axial direction of the turbine impeller 29). Here, as shown in the previously cited Patent Documents 1 and 2, the second nozzle ring 57 may include a shroud portion to cover the tip end edges 33*t* of the multiple turbine blades 33.

As shown in FIG. 1 and FIG. 2, multiple variable nozzles 61 are disposed between the facing surface of the first nozzle ring 47 and the facing surface of the second nozzle ring 57. The multiple variable nozzles 61 are disposed to surround the turbine impeller 29 at equal intervals in the circumferential direction. Each variable nozzle 61 is provided to be rotatable in forward and reverse directions (in opening and closing directions) about its pivot which is parallel to the pivot S of the turbine impeller 29. A nozzle shaft 63 is integrally formed on a right side surface (a side surface on the one side in the aforementioned axial direction) of each variable nozzle 61. Each nozzle shaft 63 is rotatably supported by a corresponding support hole 49 provided in the first nozzle ring 47. Stopper pins (not shown) are provided at appropriate positions between the facing surface of the first nozzle ring 47 and the facing surface of the second nozzle ring 57. The stopper pins (not shown) retrain rotation of the multiple variable nozzles 61 in the forward direction (or the reverse direction) beyond predetermined rotational positions. In this embodiment, each variable nozzle 61 includes the single nozzle shaft 63. However, another nozzle shaft (not shown) may be integrally formed on a left side surface (a side surface on the other side in the aforementioned axial direction) of each variable nozzle 61 and such another nozzle shaft may be rotatably supported by another corresponding support hole (not shown) in the second nozzle ring 57. In the meantime, the variable nozzles 61 are provided at constant intervals in the circumferential direction in this embodiment. However, such intervals do not always have to be constant in consideration of the shapes and other factors of the individual variable nozzles 61.

An annular container chamber 65 is formed on the opposite side (the one side in the aforementioned axial direction) of the first nozzle ring 47 from the facing surface. A mechanism for causing the multiple variable nozzles 61 to synchronously rotate in the forward direction or the reverse direction (in the opening direction or the closing direction) is provided inside the container chamber 65.

The mechanism for causing the multiple variable nozzles 61 to synchronously rotate in the forward and reverse directions will be described. As shown in FIG. 1 to FIG. 3, the guide grooves 53 of the guide claws 51 guide a drive ring 67 in such a manner that the drive ring 67 can rotate about the pivot S of the turbine impeller 29 (the pivot of the first nozzle ring 47). The drive ring 67 rotates in the forward direction or the reverse direction by drive of a rotary actuator 69 such as an electric motor or a hydraulic cylinder. In addition, engagement recessed portions (engagement portions) 71 are formed in an inner edge portion of the drive ring 67. The engagement recessed portions 71 retreats radially outward in the drive ring 67. The engagement recessed portions 71 are as many as the variable nozzles 61. Another engagement recessed portion (another engagement portion) 73 is formed at an appropriate position in the inner edge portion of the drive ring 67. Like the engagement recessed portions 71, the engagement recessed portion 73 also retreats radially outward in the drive ring 67. Moreover, base portions of synchronous link members (nozzle link members) 75 are integrally connected to the nozzle shafts 63 of the variable nozzles 61. A tip end portion of each synchronous link member 75 is engaged with the corresponding engagement recessed portion 71 in the drive ring 67.

A drive shaft 77 is provided on a left side portion of the bearing housing 3, which is a fixed portion of the variable geometry system turbocharger 1, through the intermediary of a bush 79. The drive shaft 77 is provided rotatably about its pivot which is parallel to the pivot of the turbine impeller 29. A right end portion (one end portion) of the drive shaft 77 is connected to the rotary actuator 69 through a power transmission mechanism 81. Meanwhile, a base end portion of a drive link member 83 is integrally connected to a left end portion (the other end portion) of the drive shaft 77. A tip end portion of the drive link member 83 is engaged with the other engagement recessed portion (the other engagement portion) 73 of the drive ring 67.

As shown in FIG. 1, FIG. 2, FIG. 3, FIG. 5A, and FIG. 5B, a support ring 85 is integrally provided on the opposite surface (the side surface on the one end side in the aforementioned axial direction) of the first nozzle ring 47 from the facing surface. The support ring 85 has the diameter greater than the diameter of the first nozzle ring 47. An inner edge portion of the support ring 85 is integrally joined to the opposite surface of the first nozzle ring 47 from the facing surface using right end portions (one end portions) of the multiple connecting pins 59. In addition, multiple joining pieces 87 are formed integrally with the support ring 85 on an inner peripheral surface of the support ring 85. The multiple joining pieces 87 protrude radially inward from the support ring 85. Moreover, the multiple joining pieces 87 are provided at intervals in the circumferential direction of the support ring 85. The joining pieces 87 are joined integrally to the opposite surface of the first nozzle ring 47 from the facing surface. Each joining piece 87 is provided with an insertion hole 89 for allowing insertion of the right end portion of the corresponding connecting pin 59. Each insertion hole 89 penetrates the joining piece 87. An outer edge portion of the support ring 85 is attached to the bearing housing 3 while sandwiched between the bearing housing 3 and the turbine housing 27. As a consequence of the attachment of the outer edge portion of the support ring 85 to the bearing housing 3, the variable nozzle unit 45 is disposed inside the turbine housing 27.

As shown in FIG. 1 and FIG. 2, multiple seal rings 91 are provided between an inner peripheral surface of the second nozzle ring 57 and a certain position of the turbine housing 27. The seal rings 91 suppress leakage of the exhaust gas from the opposite surface side of the second nozzle ring 57 from the facing surface.

Now, operation and effect of the embodiment of the present invention will be described.

The exhaust gas introduced from the gas introduction port 35 is fed from the inlet side to the outlet side of the turbine impeller 29 through the turbine scroll flow chamber 37. Thus, the rotational force (the rotational torque) is generated by using the pressure energy of the exhaust gas. The rotor shaft 9 and the compressor impeller 13 can rotate integrally with the turbine impeller 29 by using the generated rotational force. This makes it possible to compress the air introduced from the air introduction port 19 and to emit the air from the air emission port 25 through the diffuser passage 21 and the compressor scroll passage 23. Thus, it is possible to supercharge (compress) the air to be supplied to the engine.

While the variable geometry system turbocharger 1 is in operation, if the number of revolutions of the engine is in a high revolution range and a flow rate of the exhaust gas is accordingly high, the drive shaft 77 rotates in one direction by the drive of the rotary actuator 69 and the drive link member 83 swings in the one direction. The drive ring 67 rotates in the forward direction by the swing of the drive link member 83. When the drive ring 67 rotates in the forward direction, the multiple synchronous link members 75 swing in the forward direction whereby the multiple variable nozzles 61 synchronously rotate in the forward direction (the opening direction). The aperture of each of the variable nozzles 61 is increased by the rotation of the multiple variable nozzles 61 in the forward direction. Thus, it is possible to increase the passage area for (the flow rate of) the exhaust gas to be supplied to the turbine impeller 29 side, and to supply a large amount of the exhaust gas to the turbine impeller 29 side.

If the number of revolutions of the engine is in a low revolution range and the flow rate of the exhaust gas is accordingly low, the drive shaft 77 rotates in the other direction by the drive of the rotary actuator 69 and the drive link member 83 swings in the other direction. The drive ring 67 rotates in the reverse direction by the swing of the drive link member 83. When the drive ring 67 rotates in the reverse direction, the multiple synchronous link members 75 swing in the reverse direction whereby the multiple variable nozzles 61 synchronously rotate in the reverse direction. The aperture of each of the variable nozzles 61 is reduced by the rotation of the multiple variable nozzles 61 in the reverse direction. Thus, it is possible to reduce the passage area for the exhaust gas to be supplied to the turbine impeller 29 side so as to increase a flow speed of the exhaust gas, thereby securing a sufficient workload of the turbine impeller 29.

The multiple guide claws 51 are formed integrally on the right side surface of the first nozzle ring 47 outside the support holes 49 in the radial directions and radially at intervals in the circumferential direction. The guide groove 53 with the U-shaped cross section is provided on the tip end side of each guide claw 51. Accordingly, it is possible to provide the first nozzle ring 47 with a function as a guide ring to support the drive ring 67 in such a manner that the drive ring 67 can rotate in the forward direction and the reverse direction about the pivot S of the turbine impeller 29. Thus, an otherwise needed guide ring can be omitted from the mechanism for causing the multiple nozzles 61 to rotate synchronously in the forward direction and the reverse direction. It is to be noted that the cross-sectional shape of each of the guide grooves 53 may be arbitrarily designed insofar as the guide grooves 53 can stably and rotatably support the guide ring. For instance, one of the two side surfaces to define the guide groove 53 may be omitted. In this case, the cross section of the guide groove 53 is formed into an L-shape, for example.

The guide grooves 53 of the guide claws 51 are formed by lathe turning. As a consequence, it is possible to locate the bottom surfaces 53*b* of the guide grooves 53 accurately on the same circumference C. In addition, since the projecting portion 55 is formed at the inner edge portion on the right side surface of the first nozzle ring 47, it is possible to increase the rigidity of each of the guide claws 51 and thereby to suppress deformations of the multiple guide claws 51 while the variable geometry system turbocharger 1 is in operation. Moreover, when the projecting portion 55 is formed in such a way as to connect the base portions of the multiple guide claws 51 to one another, the projecting portion 55 can further increase the rigidity of the multiple guide claws 51 and further suppress the deformations of the multiple guide claws 51.

As described above, the otherwise needed guide ring can be omitted from the mechanism for causing the multiple nozzles 61 to rotate synchronously in the forward direction and the reverse direction. As a consequence, it is possible to reduce the number of components of the variable nozzle unit 45, and thereby to simplify the configuration of the variable nozzle unit 45 and to reduce manufacturing costs of the variable nozzle unit 45. In other words, it is possible to simplify the configuration of the variable geometry system turbocharger 1 and to reduce manufacturing costs of the variable geometry system turbocharger 1.

In addition, the bottom surfaces 53*b* of the guide grooves 53 can be located accurately on the same circumference C and the deformations of the multiple guide claws 51 can be suppressed while the variable geometry system turbocharger 1 is in operation. Accordingly, it is possible to stabilize a rotating operation of the drive ring 67 and to improve reliability (operational reliability) of the variable nozzle unit 45, or reliability of the variable geometry system turbocharger 1.

Note that the present invention is not limited only to the descriptions of the embodiment stated above but can also be embodied in various other modes. It is to be also understood that the scope of rights encompassed by the present invention are not limited to these embodiments.

What is claimed is:

1. A variable nozzle unit configured to adjust a passage area for an exhaust gas to be supplied to a turbine impeller in a variable geometry system turbocharger, comprising:

a base ring disposed concentrically with the turbine impeller, the base ring including a plurality of support holes arranged in a circumferential direction of the base ring, and a plurality of guide claws formed integrally on a side surface of the base ring on one side in an axial direction of the turbine impeller and located radially at intervals in the circumferential direction, each guide claw having a guide groove on a tip end side thereof;

a plurality of variable nozzles disposed in the base ring in the circumferential direction to surround the turbine impeller, each variable nozzle being disposed rotatably about a pivot which is parallel to a pivot of the turbine impeller;

a drive ring guided by the guide grooves of the guide claws so as to rotate in any of a forward direction and a reverse direction about the pivot of the turbine impeller, the drive ring including a plurality of engagement portions provided in a circumferential direction of the drive ring; and a plurality of synchronous link members, each including a base end portion integrally connected to a nozzle shaft of the corresponding variable nozzle, and a tip end portion engaged with the corresponding engagement portion of the drive ring, wherein each guide claw of the base ring is located between adjacent two of the synchronous link members in the circumferential direction.

2. The variable nozzle unit according to claim 1, wherein the base ring comprises a projecting portion provided on an inner edge portion of the side surface on the one side in the axial direction of the turbine impeller, and formed to protrude toward the one side in the axial direction of the turbine impeller and to be integrated with the guide claws.

3. The variable nozzle unit according to claim 2, wherein the guide grooves of the guide claws are formed by lathe turning.

4. The variable nozzle unit according to claim 3, further comprising:

a drive shaft provided to be rotatable about a pivot which is parallel to the pivot of the turbine impeller, and having one end portion connected to a rotary actuator which rotates the drive ring; and a drive link member having a base end portion integrally connected to another end portion of the drive shaft, wherein the drive ring further includes another engagement portion engaged with a tip end portion of the drive link member.

5. The variable nozzle unit according to claim 2, further comprising:

a drive shaft provided to be rotatable about a pivot which is parallel to the pivot of the turbine impeller, and having one end portion connected to a rotary actuator which rotates the drive ring; and a drive link member having a base end portion integrally connected to another end portion of the drive shaft, wherein the drive ring further includes another engagement portion engaged with a tip end portion of the drive link member.

6. The variable nozzle unit according to claim 1, wherein the guide grooves of the guide claws are formed by lathe turning.

7. The variable nozzle unit according to claim 6, further comprising:

a drive shaft provided to be rotatable about a pivot which is parallel to the pivot of the turbine impeller, and having one end portion connected to a rotary actuator which rotates the drive ring; and a drive link member having a base end portion integrally connected to another end portion of the drive shaft, wherein the drive ring further includes another engagement portion engaged with a tip end portion of the drive link member.

8. The variable nozzle unit according to claim 1, further comprising:

a drive shaft provided to be rotatable about a pivot which is parallel to the pivot of the turbine impeller, and having one end portion connected to a rotary actuator which rotates the drive ring; and a drive link member having a base end portion integrally connected to another end portion of the drive shaft, wherein the drive ring further includes another engagement portion engaged with a tip end portion of the drive link member.

9. A variable geometry system turbocharger configured to supercharge air to be supplied to an engine by using energy of an exhaust gas from the engine, comprising the variable nozzle unit according to claim 1.

10. The variable nozzle unit according to claim 1, wherein the plurality of engagement portions of the drive ring are formed in an inner edge of the drive ring and retreat radially outward as recesses.

* * * * *